United States Patent [19]

De Gonet

[11] Patent Number: 4,703,951

[45] Date of Patent: Nov. 3, 1987

[54] BOOKBINDING

[76] Inventor: Jean De Gonet, 22.24 rue de Belleville, Paris 75020, France

[21] Appl. No.: 839,071

[22] Filed: Mar. 13, 1986

[30] Foreign Application Priority Data

Mar. 18, 1985 [FR] France ..... 85 03943

[51] Int. Cl.[4] ..... B42D 1/06; B42F 13/00; B42F 9/00

[52] U.S. Cl. ..... 281/27; 402/80 R; 402/500

[58] Field of Search ..... 281/27, 36, 37, 46, 281/48, 50; 402/75, 70, 72, 73, 80 R, 500, 501, 502

[56] References Cited

U.S. PATENT DOCUMENTS

| | | | |
|---|---|---|---|
| 470,866 | 3/1892 | Hafely | 281/27 |
| 497,137 | 5/1893 | Sloan | 281/27 |
| 508,154 | 11/1893 | Tyrrell et al. | 281/27 |
| 645,301 | 3/1900 | Scarse | 281/27 |
| 892,363 | 6/1908 | Chivers | 281/27 |
| 3,485,564 | 12/1969 | Holes et al. | 402/500 |

*Primary Examiner*—E. R. Kazenske
*Assistant Examiner*—Paul M. Heyrana
*Attorney, Agent, or Firm*—Darby & Darby

[57] ABSTRACT

The invention relates to a bookbinding formed of quires (1) sewn along seams (2) to tapes, cords or the like (3), which are assembled with the plats (4), end-papers (5) being inserted between the plats and the quires. The end-papers (5) are made of flexible material resistant to folding and tearing and are sewn to the quires (1). The plats (4) are substantially thicker than the tapes or cords (3) and are provided externally with recesses (9) in the shape of notches or slots formed by molding, stamping or thermoforming, in registry with the bands or cords (3), the width and depth of these recesses (9) being such that the bands or cords (3) will be fully retracted therein without protruding above the surface of the plats, these recesses extending into apertures (12) having a cross-section matching that of the bands or cords (3) for allowing them to be threaded through these apertures (12).

20 Claims, 5 Drawing Figures

BOOKBINDING

This invention relates to a new type of bookbinding which can be produced industrially at a moderate cost while providing for a high-grade product having a high resistance against wear and tear and a great flexibility allowing it to be opened flat at any given page and to remain so. A further objective of the invention is to provide an attractive aspect of the bookbinding, as will befit a high-grade product.

BACKGROUND OF THE INVENTION

The art of bookbinding for the purpose of protecting books and enhancing their appearance has been practiced over several centuries by sewing together several quires onto bands or cords which are joined to paperboard plats covering the sides of the book by means of a back of leather or cloth which covers the seams and at least a part of the plats, inside which are subsequently glued ornamental end-papers, the plats themselves being covered with various kinds of decorative material.

This traditional manual method has been approximately reproduced by industrialized bookbinding methods using time-saving simplified procedures which are effective for keeping production costs down but result in rather low-grade products having a short lifetime.

The main body of the book, being formed of sewn quires, is thus prepared separately before being inserted and glued into a cover formed of the plats and the back.

On another hand, the backs of the books having this type of binding are usually provided with a strong paperboard lining for giving them some stiffness, with the result that the books cannot readily be opened flat. This causes an inconvenience for reading and also for making photographic reproductions.

A different type of bookbinding has been used in antiquity, and more particularly in Ethiopian antiquity, in which the seams and cords of the binding remain apparent and are not covered. This type of binding makes a flat opening possible, and provides for a strong resistance, but it brings about protrusions on the plats, along the passages of the cords or bands, while these remain unprotected. As a result, the shelving and handling of books causes a gradual deterioration of the cords as well as a deterioration of the plats of adjacent books on shelves. On another hand, this ancient method can only apply to books made of parchment, the intrinsic strength of which allows the protection along the back to be omitted.

It is an objective of this invention to provide a bookbinding which will avoid the drawbacks of these earlier systems and which will lend itself to the industrial production of high-grade products having a high resistance against wear and tear as well as a great flexibility of opening, together with an attractive appearance and a moderate production cost.

SUMMARY OF THE INVENTION

The bookbinding according to this invention is formed of quires sewn onto bands, cords or similar slips, which are joined to the plats, end-papers being provided between the plats and the quires, and it is characterized in that the end-papers are made of a flexible material having a high resistance against folding, tearing and stretching, said end-papers being sewn to the quires and glued onto the plats, the plats being appreciably thicker than the bands or cords and being provided on their external face with recesses having the shape of notches or slots produced by molding, stamping, or thermoforming for receiving said bands, cords or the like, the width and depth of said recesses being suitable for said bands or cords to be fully retracted therein, these recesses extending into holes having a cross-section corresponding to that of the bands or cords or the like at least for giving passage to said bands.

According to preferred embodiments of the invention:

(a) There is provided a protective back comprising interruptions or openings for the passage of bands or cords or the like, and the back is not joined to the plats but is joined to the end-papers, the plats being subsequently assembled, so that the edges of the back are thus inserted between the end-papers and the plats.

(b) The plats are made with a series of external recesses having the shape of equidistant notches or slots provided on at least one face of the plats.

(c) The plats or the end-papers are provided with glue-coated faces protected by a detachable film so that the plats may be immediately glued onto the end-papers by detaching this film;

(d) The plats are made either of plastic material, of natural or synthetic rubber, of wood or metal, or of any other material capable of being formed or deformed by molding, stamping or thermoforming;

(e) The plats have a thickness comprised between 2.5 mm and 4 mm, approximately, depending upon whether the stitching is made with bands or cords;

(f) The end-papers are made of a material such as non-woven textile, cloth, leather, plastic-coated or reinforced sheets, latex-impregnated cellulose, and more generally of flexible sheets having a tear strength and a folding strength above approximately 10 decanewton, a tensile strength above approximately 10 decanewton for a thickness to the order of 0.3 mm to 0.5 mm;

(g) The internal faces of the plats may also comprise similar recesses for receiving the ends of the bands or cords passing through holes in the bottom end of the recesses provided on the plats.

The invention will now be described in further detail, referring to the appended drawings in which.

DETAILED DESCRIPTION OF THE INVENTION

Figure 1:
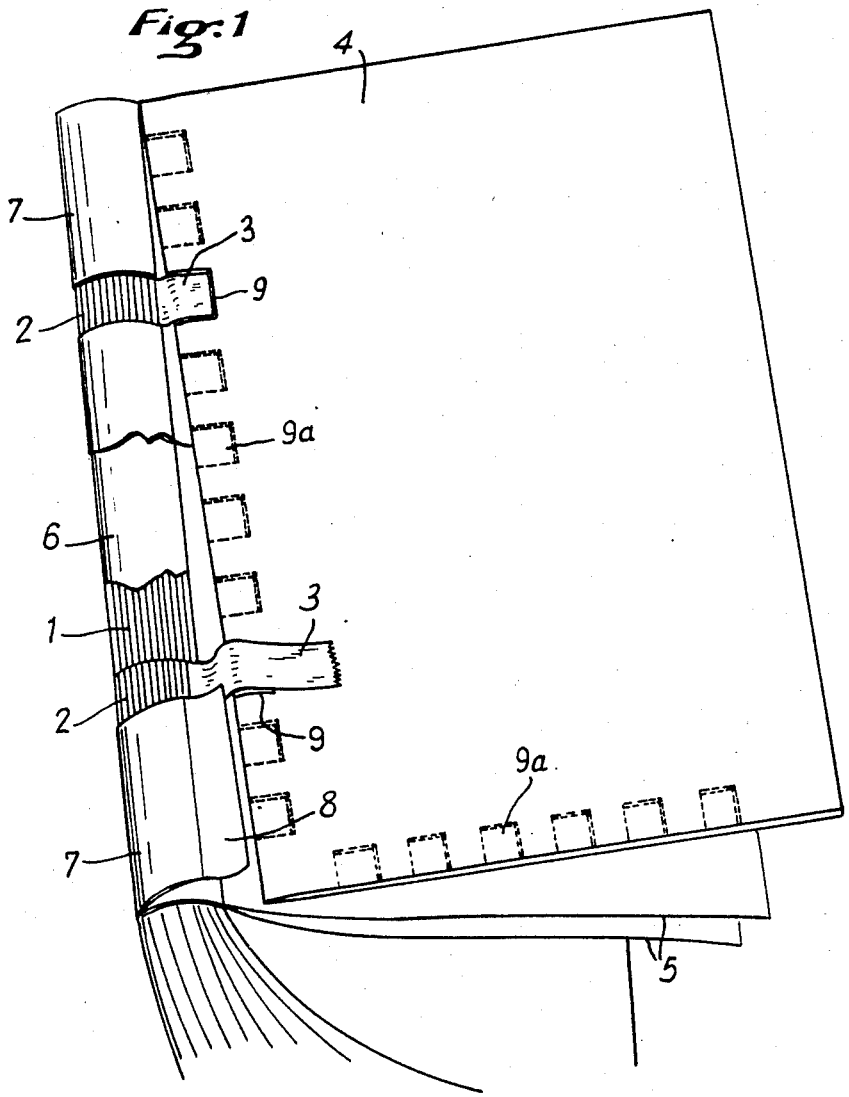
FIG. 1 is a perspective view of a bookbinding in accordance with the invention, in the course of manufacturing, some parts being partly cut away.
Figure 2:
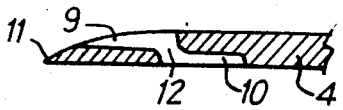
FIG. 2 shows a partial cross-section of a plat taken along the longitudinal axis of a recess.
Figure 5:
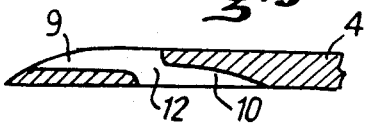
FIG. 5 shows a partial longitudinal cross-section of the recess of FIG. 4.
Figure 3:
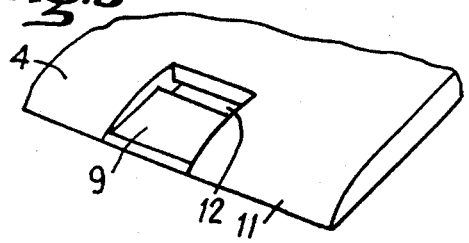
FIG. 3 is a perspective view of such a recess.
Figure 4:
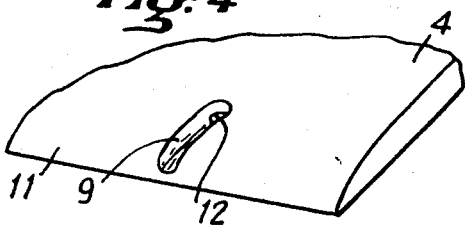
FIG. 4 is a perspective view similar to FIG. 3, showing a modified embodiment of a recess.

Referring to FIG. 1, it will be seen that the bookbinding in accordance with the invention is formed of quires 1 sewn along seams 2 onto bands or cords 3, or similar strips, which are assembled with the thick or solid plats 4.

According to the invention, the end-papers 5 are made of a material which is flexible but highly resistant to folding, tearing and stretching, and they effect a mechanical link between the quires 1 and the plats 4, on one hand by the end-papers 5 being sewn to the quires 1, and on the other hand by the end-papers 5 being glued onto the plats 4. The plats 4 are provided with recesses 9, formed during the manufacturing of the plats, either by molding or by stamping, or by thermoforming or any other suitable process. The width and depth of these recesses 9 correspond to the width and thickness of the bands or cords 3 and each recess may end with an aperture 12 having the same dimensions and shape as the cross-section of the bands or cords 3. However, the piercing of this aperture may be done manually when assembling the book.

In this type of binding, the seams 2 can remain apparent and the plats can remain completely bare. In fact, the connection between the plats and the quires is not effected by a back covering the seams together with at least a part of the plats; this connection is now effected by the end-papers 5 which are of a suitable strength for this function, while they are assembled to the quires by sewing, and to the plats and to the strips 3 by gluing. Moreover, it is no longer needed to protect the strips 3 along the flanks of the plats, since these strips are retracted within the recesses provided in the plats. Thus, it necomes possible to produce, through a sewing operation which can be industrialized, a main body comprising the quires and the high-strength end-papers, and through another operation which can also be industrialized, to fix the plats onto the end-papers by gluing after the bands or cords 3 have been inserted into the recesses. These operations are more simple, and also quicker and more efficient in respect of the strength of the completed assembly. They also allow for a separate production of ornamental or decorated plats with a high quality grade without having to carry out any decoration or finishing operation after the plats have been assembled with the quires. This is made possible by the fact that the plats no longer need to be covered (at least in part) for being assembled with the quires.

It is a feature of the invention that the end-papers 5 should possess suitable mechanical properties while remaining flexible so as to be integrated with the set of quires. These properties concern mainly the resistance to folding as well as tear strength and resistance to stretching. In fact, the main stress which they must overcome is the stress caused by repetitive opening and shutting of the books, and also by handling a book through the plats. Whereas the long lifetime of ancient bookbindings was due to the manner in which the back was made, the long-lasting quality of the bookbinding of this invention relies to a large extent upon the sewing of the end-papers.

The qualities required for the end-papers are at least those of a good non-woven textile material (produced by tufting fibers) weighing approximately 150 g/m$^2$, with a thickness from 0.3 to 0.5 mm, having a tear strength of more or less 1 decanewton, and a breaking strength of about 20.5 kg/cm$^2$, Largely superior results are obtained with a product such as a latex-impregnated alfa-cellulose (available under the brand name "Texon 481"), having a tear strength and a folding strength, as well as a stretching resistance which may exceed 15 decanewton.

However, other flexible materials having similar properties may also be used, more particularly textile fabrics, leather, plastics or plastic-coated materials, possibly reinforced with fibers (laminated papers). For the sake of aesthetics and/or protection, a masking of the edges of the quires may be provided. To this aim, there is provided, in the example illustrated, a flexible film 6 glued to the quire edges between seams 2 and there are further provided back sections 7, also between seams 2; These backing sections are clasped and fixed between the plats 4 and the end-papers 5 along their edges 8. Preferably, these backing portions are not fixed to the quires 1. Thus, these backing portions have a protective effect and they enhance the book's appearance without restricting its ability to be opened flat, this being an important advantage of the binding in accordance with the invention.

Instead of the back portions 7, there may be provided a continuous back comprising apertures for giving passage to the bands or cords 3.

The plats 4 are preferably glued to the end-papers 5 by providing on the inside face of the plats 4 (or alternatively on the outer face of the end-papers 5), a self-adhesive surface, protected by a film which is removed at the moment of gluing.

The length of the recesses 9 is preferably rather short, namely about one centimetre or even less, and a similar opposite recess 10 is advantageously provided in the inside face of the plat 4 for receiving the ends of the tapes or cords 3.

A further embodiment of the invention consists in providing plats 4 which comprise along at least one edge equidistant recesses 9 and 9*a*. This arrangement makes it possible to use the same plats for books of different formats, by cutting these plats down to the format of the book which is to be bound, placing the bands in locations corresponding to the presence of recesses and piercing the bottoms of the recesses correspondingly to the bands or cords 3.

In the same manufacturing operation by which the recesses are formed, the rear edge 11 of the plats will preferably be given a bevelled shape, as illustrated. The decoration of the plats may also be carried out in this same operation, by forming raised or sunken patterns, with or without inlays, appliques or coloring.

In FIG. 1, the upper tape 3 is shown as being already recessed into its housing 9, while the lower tape in the same figure has not yet been inserted. It will be seen that after the tape 3 has been put into place, it is completely recessed and does not in the least protrude above the surface of the plat 4. This tape is therefore protected against friction when the book is pushed onto a shelf or otherwise handled. Since the backing sections 7 are not joined to the quires 1, the book may be fully opened flat without being damaged.

In the binding of the invention, the plats 4 should be thick so that the decreased thickness in the locations where the recesses 9 are formed will not cause an excessive loss of strength. In practice, this thickness may be in the range of 2.5 to 3 mm, approximately, when tapes are being used, and from 3.5 to 4 mm, approximately, when using cords.

As regards the end-papers 5, the invention will not be restricted to the materials mentioned, since new materials are appearing all the time on the market. An important requirement, in the sense of the invention, is that the end-papers should be made of materials having properties, in respect of flexibility, folding strength and tear strength at least equal to those of materials which have formerly been used for making the backs which cover the seams and the plate, since the mechanical function which was formerly performed by these backs finds itself transferred to the end-papers.

I claim:

1. A bookbinding formed of quires sewn along seams to bands which are assembled to the plats, end papers being provided between the plats and the quires, wherein the end-papers are made of a flexible material having a high resistance against folding, tearing and stretching, said end-papers being sewn to the quires and glued onto the plats, the plats being appreciably thicker than the bands and being provided on their external face with recesses having the shape of notches or slots produced by molding, stamping or thermoforming for receiving said bands to be fully retracted therein, these recesses extending into apertures having a cross-section corresponding approximately to that of the bands for allowing said bands to be threaded through said apertures.

2. A bookbinding according to claim 1, wherein there is provided a protective back comprising gaps for giving passage to the bands, said back being fixed along its edges to the end-papers so that it will be inserted between the end-papers and the plats.

3. A bookbinding according to claim 2, characterized in that the plats are made with a series of equidistant external recesses over at least one of their faces.

4. A bookbinding according to claim 2, characterized in that the end-papers are made of a material such as non-woven textile, cloth, leather, plastic-coated or reinforced sheets, latex-impregnated cellulose, and more generally of flexible sheets having a tear strength and a folding strength above approximately 10 decanewton, with a tensile breaking strength above approximately 10 decanewton for a thickness to the order of 0.3 mm to 0.5 mm.

5. A bookbinding according to claim 2, characterized in that the assembly of the plats with the end-papers is carried out by means of faces having been glue-coated in advance, either inside the plats (4) or on the external side of the end-papers.

6. A bookbinding according to claim 2, characterized in that the plats are solid and made of plastic, natural or synthetic rubber, wood, metal or any other material capable of being shaped or deformed by molding, stamping or thermoforming.

7. A bookbinding according to claim 1, characterized in that the plats are made with a series of equidistant external recesses over at least one of their faces.

8. A bookbinding according to claim 7, characterized in that end-papers are made of a material such as non-woven textile, cloth, leather, plastic-coated or reinforced sheets, latex-impregnated cellulose, and more generally of flexible sheets having a tear strength and a folding strength above approximately 10 decanewton, with a tensile breaking strength above approximately 10 decanewton for a thickness to the order of 0.3 mm to 0.5 mm.

9. A bookbinding according to claim 7, characterized in that the assembly of the plats with the end-papers is carried out by means of faces having been glue-coated in advance, either inside the plats or on the external side of the end-papers.

10. A bookbinding according to claim 7, characterized in that the plats are solid and made of plastic, natural or synthetic rubber, metal or any other material capable of being shaped or deformed by molding, stamping or thermoforming.

11. A bookbinding according to claim 7, characterized in that the internal faces of the plats comprise recesses extending beyond the apertures.

12. A bookbinding according to claim 1, characterized in that the end-papers are made of a material such as non-woven textile, cloth, leather, plastic-coated or reinforced sheets, latex-impregnated cellulose, and more generally of flexible sheets having a tear strength and a folding strength above approximately 10 decanewton, with a tensile breaking strength above approximately 10 decanewton or a thickness to the order of 0.3 mm to 0.5 mm.

13. A bookbinding according to claim 12, characterized in that the assembly of the plats with the end papers is carried out by means of faces having been glue-coated in advance, either inside the plats or on the external side of the end-papers.

14. A bookbinding according to claim 1, characterized in that the assembly of the plats with the end-papers is carried out by means of faces having been glue-coated in advance, either inside the plats (4) or on the external side of the end-papers.

15. A bookbinding according to claim 14, characterized in that the plats are solid and made of plastic, natural or synthetic rubber, wood, metal or any other material capable of being shaped or deformed by molding, stamping or thermoforming.

16. A bookbinding according to claim 1, characterized in that the plats are solid and made of plastic, natural or synthetic rubber, wood, metal or any other material capable of being shaped or deformed by molding, stamping or thermoforming.

17. A bookbinding according to claim 16, wherein said bands are each selected from the group consisting of a single band and a group of cords forming a band-like unit, and wherein the plats have a thickness from approximately 2.5 mm to 4 mm, depending upon the selection of the bands.

18. A bookbinding according to claim 1, characterized in that the internal faces of the plats comprise recesses extending beyond the apertures.

19. A bookbinding according to claim 18, characterized in that the length of the external recesses does not exceed 1 cm, approximately.

20. A bookbinding according to claim 1 characterized in that the length of the external recesses does not exceed 1 cm, approximately.

* * * * *